US005586664A

United States Patent [19]

Taylor

[11] Patent Number: 5,586,664

[45] Date of Patent: Dec. 24, 1996

[54] DISPLAY ARRANGEMENT

[76] Inventor: Stephen D. Taylor, P.O. Box 669, Neutral Bay Junction 2089, Australia

[21] Appl. No.: 253,007

[22] Filed: Jun. 2, 1994

[51] Int. Cl.[6] ..... A47F 5/05

[52] U.S. Cl. ..... 211/58; 211/163; 211/56; 211/131

[58] Field of Search ..... 211/163, 131, 211/58, 56, 144, 129, 78, 74, 77

[56] References Cited

U.S. PATENT DOCUMENTS

| | | | |
|---|---|---|---|
| 4,026,417 | 5/1977 | Streim | 211/58 |
| 4,247,010 | 1/1981 | Eckert | 211/163 |
| 4,688,684 | 8/1987 | Young | 211/77 |
| 4,946,048 | 8/1990 | Francois | 211/34 |
| 5,178,286 | 1/1993 | Allison, III | 211/71 |

FOREIGN PATENT DOCUMENTS

| | | | |
|---|---|---|---|
| 2279003 | 12/1994 | United Kingdom | 211/78 |

*Primary Examiner*—Alvin C. Chin-Shue
*Assistant Examiner*—Willie Berry, Jr.
*Attorney, Agent, or Firm*—Robbins, Berliner & Carson, LLP

[57] ABSTRACT

A stand for exhibiting and holding articles which includes an elongate and substantially vertical shaft which extends upwardly from a base. One or more article receiving containers are rotatably mounted to the shaft. Each article receiving container includes a plurality of article receiving and holding pockets extending substantially radially outwardly from the shaft, such that the user can rotate an article receiving container, bringing a desired object stored in a distant pocket closer to the user.

11 Claims, 4 Drawing Sheets

DISPLAY ARRANGEMENT

BACKGROUND TO THE PRESENT INVENTION

Figure 1:
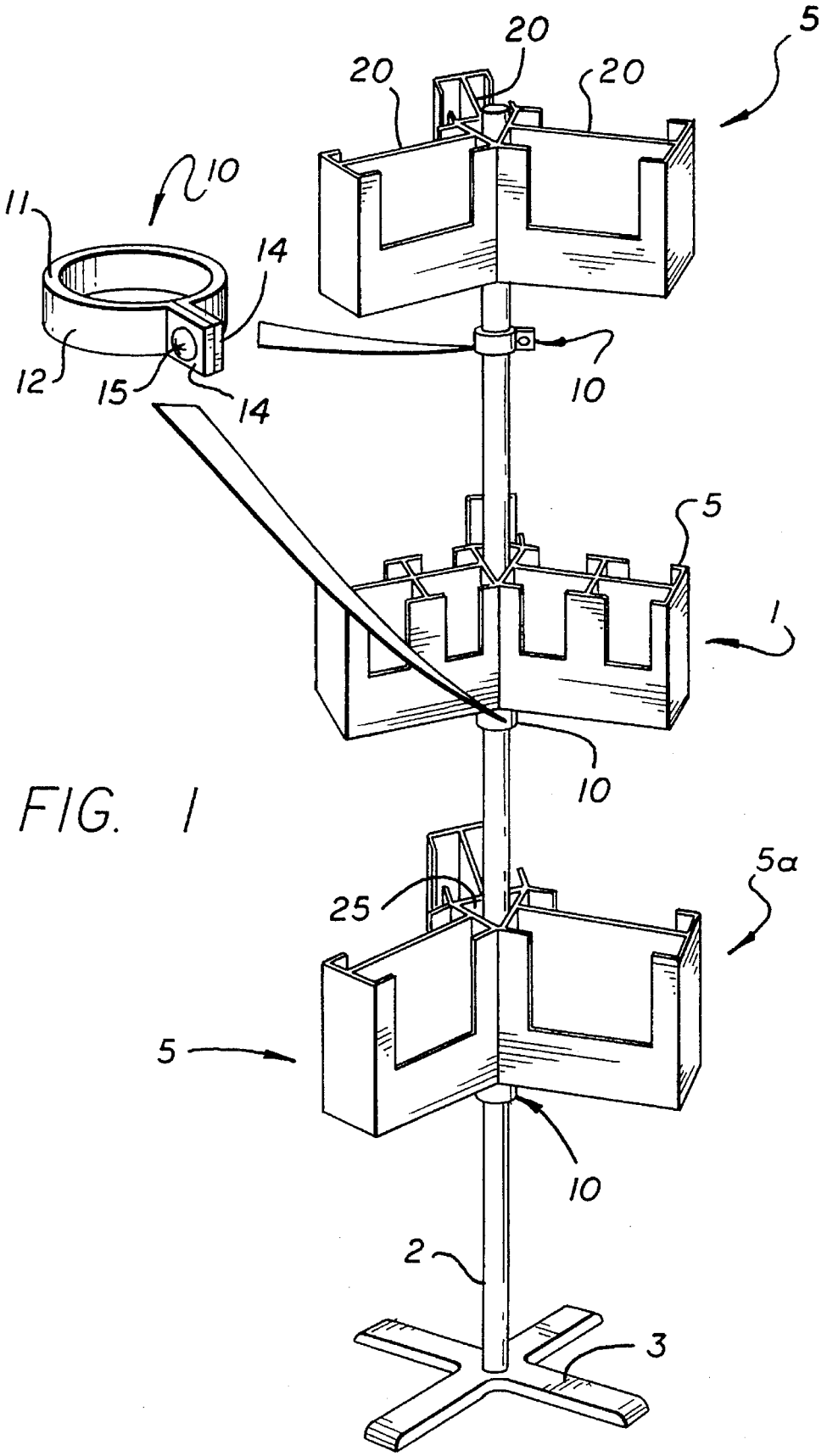

This invention relates to a display arrangement and in particular to a display arrangement substantially in the form of a carousel, having a plurality of display members extending outwardly from and being rotatable relative to a vertical, upstanding shaft.

Many forms of carousel type display arrangements are known and available. These allow for the display of printed matter, brochures, publications, postcards, and the like. The present invention provides an improved carousel type display arrangement, and it should be appreciated that the display arrangement of the present invention is able to be used to hold, present and display any form of article. Not only is the invention directed to holding and displaying matters such as at present held and displayed by carousel displays, but the present invention can be used for holding and displaying any other articles. However, in preferred forms of the invention the carousel display arrangement of the present invention may be used for displaying brochures, printed matter and the like.

One of the problems associated with carousel type display means used up until this time is that while such display means often include vertically spaced apart different levels of display members, they are often either fixed or rotatable as one, which is particularly inefficient and can be very annoying from the point of view of consumers. Where the display means are not mounted for rotation, this means that consumers must walk around the carousel so that display goods or articles can be viewed from various sides and angles. In situations where the carousel rotatably mounts display means, such display means are usually rotatable together. Thus, when a customer is viewing a display member from one side and another customer is viewing the same or another display member from another side, problems arise when, on one person finishing, and wishing to rotate the display member (to view another display member or another side of the same display member), and on such rotation taking place, this moves the display member being viewed by one or more other customers away from them. This can cause substantial annoyance and irritation and can result in substantial customer irritation and dissatisfaction.

The present invention sets out to go some way towards overcoming or at least minimising some of the problems set out above.

The present invention also sets out to provide, in at least one form thereof, a straightforward and efficient carousel display arrangement.

Other objects of this invention will become apparent from the following description.

SUMMARY OF THE PRESENT INVENTION

According to one aspect of this invention there is provided a display arrangement including an elongate and substantially vertical shaft, extending upwardly from a base; one or more article receiving and holding modules being provided and so formed and adapted as to be mounted to said shaft, so that a plurality of article receiving and holding means extend substantially radially outwardly from said shaft; said one or more modules being independently rotatable about and relative to said shaft.

According to a further aspect of this invention there is provided a display arrangement including an elongate and substantially vertical shaft, extending upwardly from a base; a plurality of article receiving and holding modules being provided and being so formed and adapted as to be mounted to said shaft so as to be vertically spaced apart, one from the other; each article receiving and holding module including a plurality of article receiving and holding means connected at or adjacent inner ends thereof, and being mounted about said shaft so as to extend substantially radially outwardly therefrom; said one or more modules being independently rotatable about and relative to said shaft.

According to a further aspect of this invention there is provided a display arrangement including an elongate and substantially vertical shaft, extending upwardly from a base; a plurality of article receiving and holding modules being provided and being so formed and adapted as to be mounted to said shaft; a plurality of module mounting and bearing means being adjustably attached to said shaft and being spaced apart vertically one from the other, so as to rotatably mount a plurality of article receiving and holding modules, vertically spaced apart one from the other.

BRIEF DESCRIPTION OF ACCOMPANYING DRAWINGS

Figure 2:
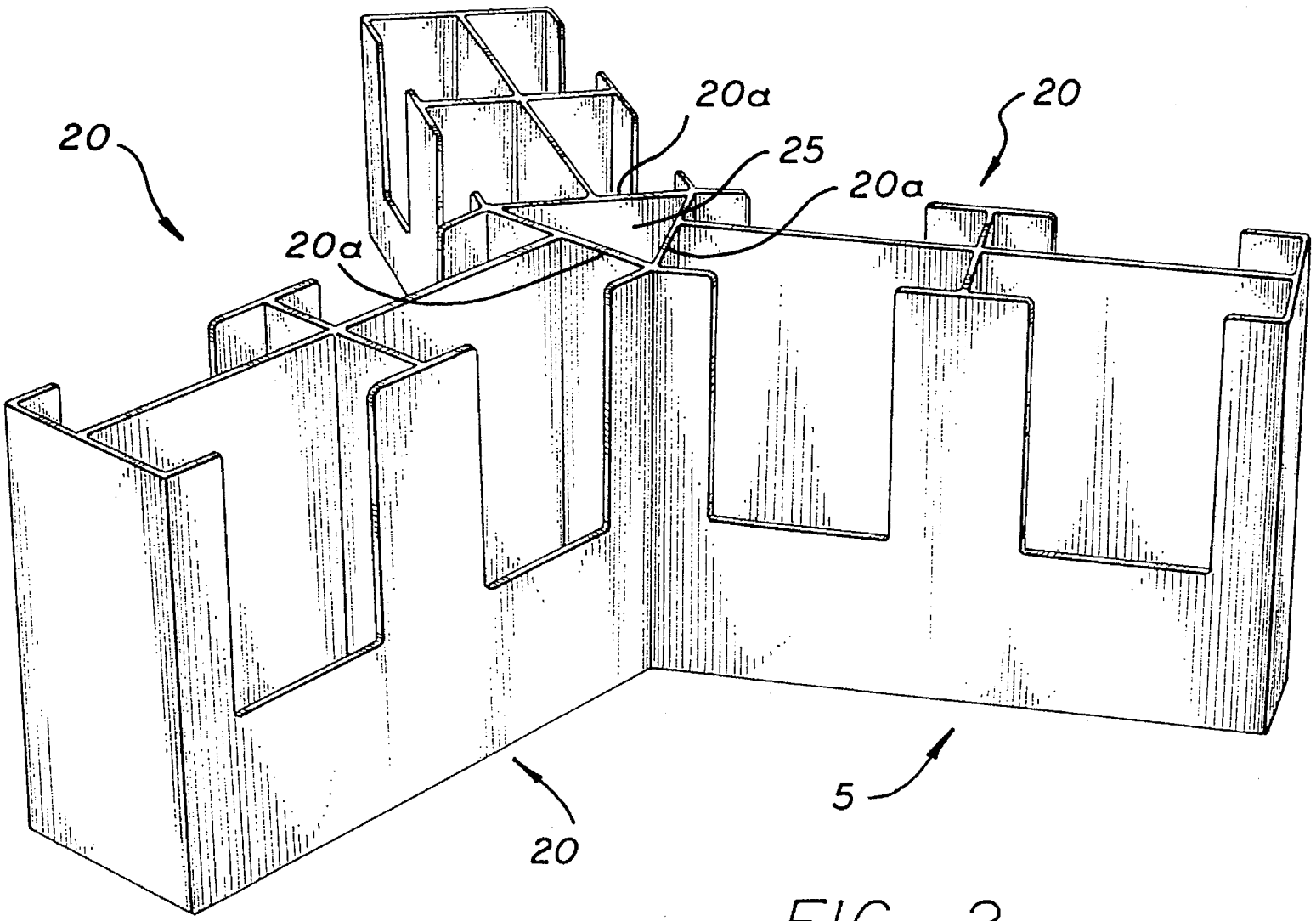
Figure 3:
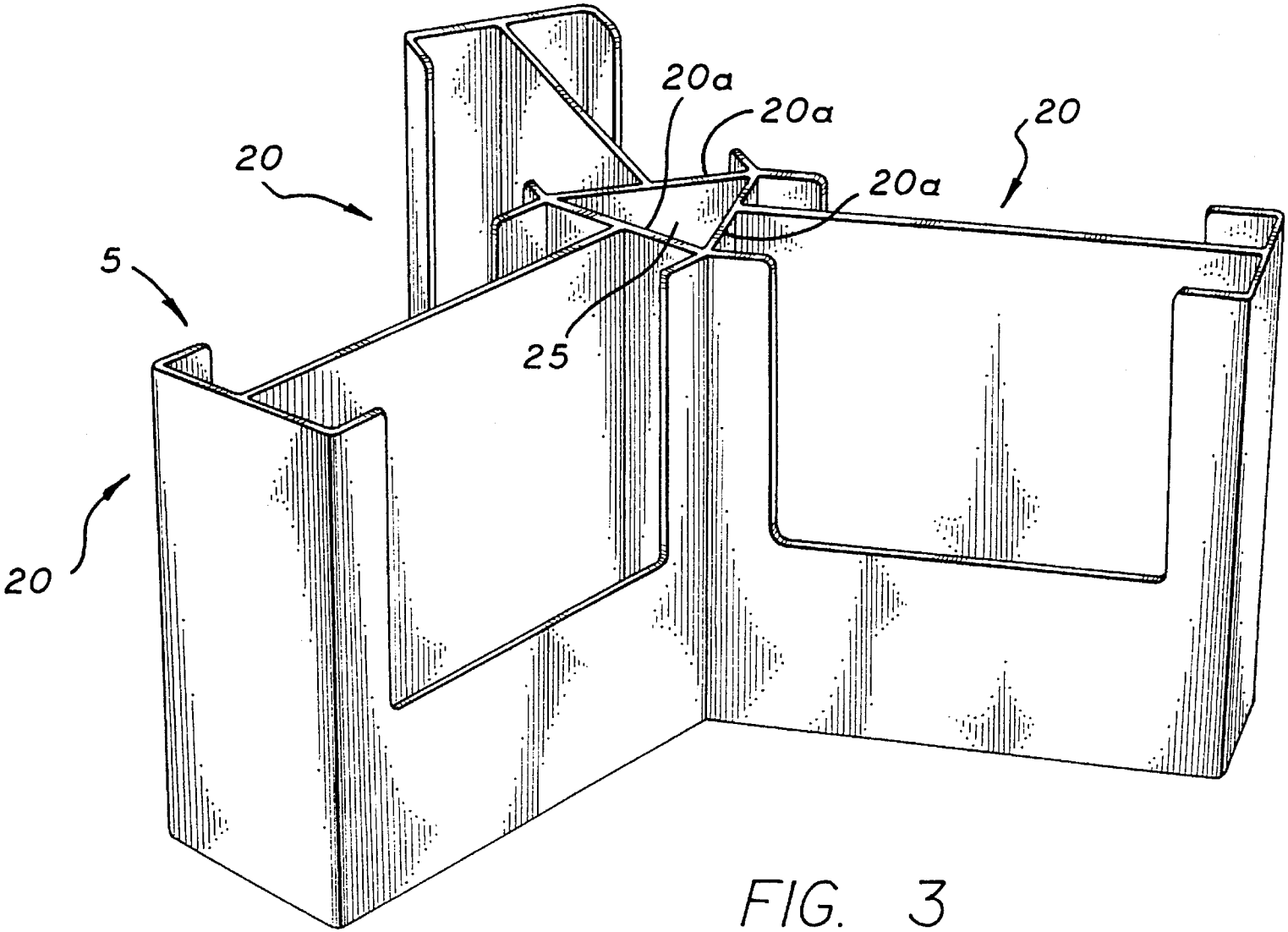
Figure 4:
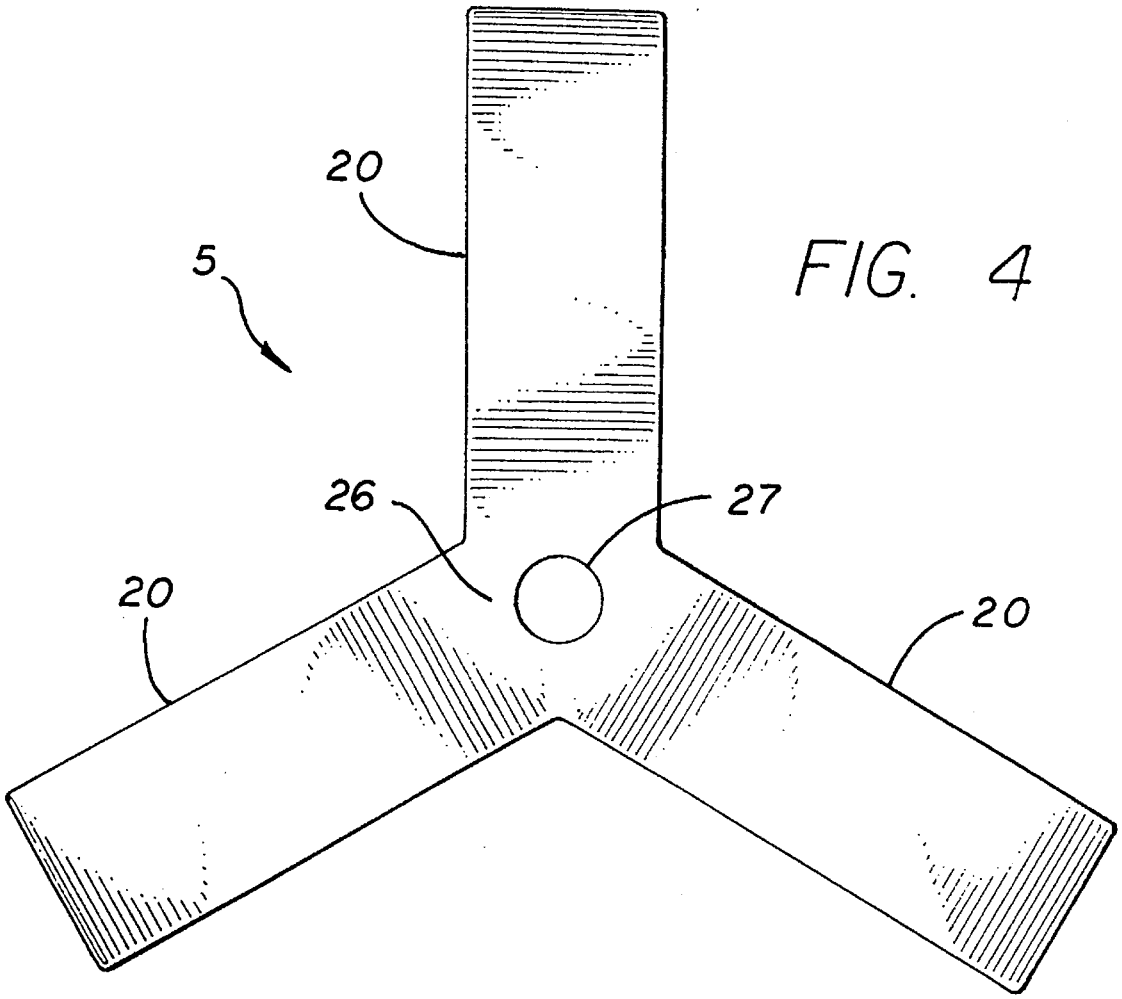

The invention will now be described by way of example only and with reference to the accompanying drawings, wherein:

FIG. 1 is a general perspective view of a display arrangement according to one form of the present invention, FIG. 2 is a perspective view of a module according to one form of the present invention, FIG. 3 is a perspective view of a further form of a module according to one form of the present invention, FIG. 4 is an inverted plan view or underside view of a module as shown in FIG. 2 or FIG. 3 of the accompanying drawings.

Referring to the accompanying drawings, it will be seen that a carousel display arrangement 1 is shown in FIG. 1 of the drawings, the display arrangement 1 including an elongate vertical shaft 2, mounted on and extending upwardly from a base 3. The shaft 2 and base 3 can be constructed of any appropriate material, such as for example plastic, metal, wood or the like. Preferably, the shaft 2 is substantially circular in cross section.

As shown in FIG. 1 of the accompanying drawings, a plurality of modules 5 are mounted along the length of the shaft 2, so as to be vertically spaced one from the other. The modules 5 are mounted on the shaft 2 so as to be independently rotatable relative to each other. This means that from a customer point of view, a customer can be viewing a module 5 from one side of the display arrangement, while a customer is viewing another module from the other side. When the customers wish to rotate the modules 5 to view other articles on the other side of that particular module, this can be done without the need to rotate all modules. As indicated above, this has previously caused customer frustration and irritation. Further, by having the various members or arms of each module 5 angled or splayed outwardly, a viewer or customer can view a number of differing displayed articles at any one time, and from a number of different positions and angles.

Referring further to FIG. 1 of the accompanying drawings, module mounting and bearing means 10 are provided in the form of a clip or circlip, which is substantially circular and adapted to fit over and/or about the vertical shaft 2. The module mounting and bearing means 10 are preferably formed of a plastics material (although other materials can be used) and are substantially circular or semi-circular, having an upper flat bearing surface 11. The clips 10 are, in one form of the invention, substantially "C" shaped as at 12 in FIG. 1 of the drawings, with outwardly extending lugs or arms 14 at the ends thereof, the lugs or arms 14 being connected together by a screw or similar securing means 15, so that on the clip 10 being placed over or about the shaft 2 and moved into a desired position on the shaft 2, and on the screw 15 being tightened, the clip will be securely tightened in an adjustable manner to and about the shaft 2. If it is desired to adjust the location of the clip, or mounting and bearing means 10 (for example, longitudinally relative to the shaft 2), this can be done by adjustment of the screw or other securing means 15.

In the form of the invention shown in FIG. 1 of the accompanying drawings, three vertically spaced apart article receiving and holding modules 5 are shown. This is however by way of example and it should be appreciated that any number of article receiving and holding modules 5 can be used. If desired, only one can be provided or alternatively any number of modules. The invention is described by way of example only, with reference to the three modules 5 shown in FIG. 1 of the drawings.

In order to locate the modules 5 on the shaft 2, as shown in FIG. 1 of the drawings, the lowermost clip 10 is secured to the shaft at the desired position and a module 5 such as the lower module 5*a* shown in FIG. 1 is then fed over the shaft 2 and moved down to sit on the upper flat surface 11. As will be described further hereinafter, the article receiving and holding members 20 of each module 5 are secured together at or adjacent their inner ends 20*a*, forming a triangular sleeve around said shalt (as shown in FIGS. 1–3), so as to provide a spacing or gap 25 therebetween and so as to extend out substantially radially from said spacing 25 (and from the shaft 2 when the modules 5 are mounted on the shaft 2). An inner underside 26 of the modules 5 (as shown with reference to FIG. 4 of the drawings) is provided with a substantially circular hole 27, which enables the modules 5 to be fed over the shaft 2 and the underside 26 of each module 5 (as shown in FIG. 4 of the accompanying drawings) is seated on the flat upper bearing surface 11 of each mounting and bearing clip 10, so that each module 5 is rotatable about the shaft 2 and independently of any other module(s) mounted on the shaft 2.

This procedure is followed in so far as the mount of clips 10 and modules 5 are concerned, along the length of the shaft 2 until the desired number of modules 5 have been mounted.

The article receiving and holding modules 5 used in the present invention are shown by way of example only in FIGS. 1, 2 and 3 of the accompanying drawings. These modules 5 can be of varying sizes and configurations to hold and display articles, depending upon the desires of the user. For example, the modules can hold varying publications, cards, papers or documents. Alternatively, modules enabling the display of other goods, foodstuffs and the like could be used. Varying forms of article receiving and holding members 20 are shown in the module shown by way of example only in FIGS. 2 and 3 of the accompanying drawings. Further, various forms of differing modules can be used, having differing holding members so as to enable the modules and holding members to be essentially 'mixed and matched' to allow for the holding and/or display of differing articles and differing sized articles, at different levels and/or positions.

Preferably, each module 5 includes a plurality (for example 3) of article receiving and holding members 20 which have substantially flat inner ends 20*a*, sides of which are abutted against each other so that the inner side ends are in juxtaposition and connected, thus forming a substantially angular recess, gap or space 25 where the article receiving and holding members 20 meet and from which the article receiving and holding members 20 extend outwardly from each other at angles (as shown in the accompanying drawings and in particular FIGS. 1, 2 and 3 thereof). As referred to hereinbefore, and with reference to FIG. 4, the underside(s) 26 of the modules 5 have a circular bore or hole 27 passing therethrough, so that each module 5 can fit over and relative to the shaft 2. As will be appreciated, and as shown with reference to FIG. 1 of the accompanying drawings, when the modules 5 are in position on the shaft 2, mounted appropriately on mounting and bearing clips 10, the article receiving and holding members 20 extend outwardly substantially radially from the shaft 2.

It should however be appreciated that the clip means, and mounting and bearing means 10 are described by way of example only, and that varying forms of means for holding and rotatably mounting the modules 5 in position, can be used.

In the preferred form of the invention the modules 5 are formed with article receiving and holding members 20 which have varying sized pockets, preferably on both faces thereof to hold as much information and as many articles as required. As shown in FIGS. 1–3, the pockets have at least three substantially vertical walls for holding articles in a substantially vertical orientation. The form of such article receiving and holding members can vary, depending upon the desires of the user. The modules 5 and members 20, and the shape and configuration thereof, as described herein and as shown in the accompanying drawings are purely by way of example only. It should be appreciated however that the modules 5 shown in FIGS. 1, 2 and 3 of the accompanying drawings may well be particularly appropriate for the holding and display of papers, published matter, cards and the like. As will be appreciated, one or more pockets of various sizes can be provided on one or both sides of each article receiving and holding members 20 of each module 5.

In a preferred form of the invention the modules 5 are integrally formed and moulded of a plastics material, although if desired, each member 20 could be manufactured separately and a plurality thereof connected together such as by bonding or sealing, to form each module. Further, if desired, other materials could be used.

The present invention provides a straightforward and efficient carousel type display means which goes some way towards overcoming problems associated with such carousels known and used up until this time, and which also provides the public with a reasonable choice of product.

It should be appreciated that modifications and improvements may be made to the invention without departing from the scope thereof, as defined by the appended claims.

I claim:

1. A display arrangement including an elongate and substantially vertical shaft, extending upwardly from a base; at least two article receiving and holding modules being provided and so formed and adapted as to be mounted to said shaft, so that three article receiving and holding arms extend substantially radially outwardly from said shaft, each of said article receiving and holding arms having at least three substantially vertical walls adapted for containing articles in substantially vertical orientation, an inner end wall, an outer end wall and a back wall, wherein the inner end walls of the three article receiving and holding arms abut one another in a triangular relationship about the vertical shaft; each of said modules being independently rotatable about and relative to said shaft.

2. A display arrangement as claimed in claim 1, wherein each article receiving and holding module includes a plurality of article receiving and holding arms connected at or adjacent to the inner ends thereof, and being mounted about said shaft so as to extend substantially radially outwardly therefrom, each of said article receiving and holding arms comprising at least one pocket for displaying articles.

3. A display arrangement as claimed in claim 2, wherein one or more module mounting and bearing means are adjustably attached to said shaft so as to rotatably locate in position said one or more article receiving and holding modules.

4. A display arrangement as claimed in claim 3, wherein a plurality of article receiving and holding modules are mounted about said vertical shaft, so as to be vertically spaced apart one from the other; a plurality of vertically spaced apart module mounting and bearing means being adjustably attached to said shaft so as to vertically space apart said article receiving and holding modules and so as to allow for independent rotation thereof about and relative thereto said shaft and each other.

5. A display arrangement as claimed in claim 4, wherein said plurality of article receiving and holding arms are so connected at or adjacent inner ends thereof, as to provide an inner spacing or bore therebetween to allow for said module to be slidable engaged over said shaft; and underside of each article receiving and holding module being formed so as to engage with an upper surface of module mounting and bearing means.

6. A display arrangement as claimed in claim 5, wherein each module mounting and bearing means is in the form of an adjustable clip adapted to engage over and about said shaft and which is provided with means to adjustably engage said clip relative to said shaft; an upper surface of said clip providing a bearing surface adapted to engage with an underside of one of said article receiving and holding modules.

7. A display arrangement as claimed in claim 6, formed of a plastics material.

8. A display arrangement as claimed in claim 7, wherein said one or more article receiving and holding module(s) are integrally formed and moulded of a plastics material.

9. A display arrangement including an elongate and substantially vertical shaft extending upwardly from a base; a plurality of article receiving and holding modules being provided and each including three article receiving and holding arms connected at or adjacent to the inner end walls thereof so as to provide a bore or spacing therebetween at or adjacent said inner end walls thereof, and so as to allow for said plurality of article receiving and holding modules to be engaged over and about said shaft; a plurality of module mounting and bearing means being adjustably attached to said shaft such as to be vertically spaced apart one from the other and each mounting a vertically spaced apart article receiving and holding module; said article receiving and holding arms of each module extend radially outwardly from said shaft, each of said article receiving and holding arms having at least three substantially vertical walls adapted for containing articles in substantially vertical orientation, an inner end wall, an outer end wall and a back wall, wherein the inner end walls of the three article receiving and holding arms abut one another in a triangular relationship, and wherein said receiving and holding modules are able to rotate independently of each other relative to and about said shaft.

10. A display arrangement as claimed in claim 2, wherein one of the walls in each pocket of an article receiving and holding arm is in contact with an adjacent pocket in a back-to-back relationship.

11. A display arrangement as claimed in claim 2, wherein said pocket has a forward cut-away wall for securing articles within the pocket and viewing the contents thereof.

* * * * *